US005448798A

United States Patent [19]

Coleman et al.

[11] Patent Number: 5,448,798

[45] Date of Patent: Sep. 12, 1995

[54] LOW PROFILE OVERHEAD MOUNTED DOOR HOLDER ASSEMBLY

[75] Inventors: Michael D. Coleman, Indianapolis; Raymond A. Loturco, Columbus, both of Ind.

[73] Assignee: Von Duprin, Inc., Indianapolis, Ind.

[21] Appl. No.: 138,525

[22] Filed: Oct. 15, 1993

[51] Int. Cl.[6] ..... E05F 5/00

[52] U.S. Cl. ..... 16/85; 292/273

[58] Field of Search ..... 16/63–65, 16/72, 78, 85; 49/394; 292/273, 274, 277, 278

[56] References Cited

U.S. PATENT DOCUMENTS

| | | | |
|---|---|---|---|
| 3,601,842 | 8/1971 | Morrison et al. | 292/274 |
| 4,750,236 | 6/1988 | Teague, Jr. | 292/278 |
| 4,837,890 | 6/1989 | Tully et al. | 16/71 |
| 4,858,272 | 8/1989 | Ogawa et al. | 16/80 |

*Primary Examiner*—S. Thomas Hughes

*Assistant Examiner*—Kenneth S. Hansen

*Attorney, Agent, or Firm*—Robert F. Palermo; A. James Richardson

[57] ABSTRACT

An overhead mounted door holder assembly, for attachment between a door jamb and a door, to hold the door in an open position includes a jamb bracket attached to the door jamb and a jamb arm pivotally attached to the jamb bracket. A channel assembly having a longitudinally extending channel is attached to the door. A slide assembly is disposed within the channel and is pivotably connected to the jamb arm. A slide catch on the slide assembly is provided for the door holding function. First and second springs are attached to the channel assembly and positioned within the channel, and a spring mounted catch is attached to the first and second springs. In operation, the spring mounted catch is pivotably positioned in the channel to engage the slide catch and reversibly hold the door in an open position.

15 Claims, 3 Drawing Sheets

LOW PROFILE OVERHEAD MOUNTED DOOR HOLDER ASSEMBLY

BACKGROUND OF THE INVENTION

This invention relates generally to door holder assemblies, and, more particularly, to an overhead mounted door holder assembly having a low profile suitable for mounting in a door top inset.

It is often desired to temporarily hold a door in an open position for convenience and safety. One commonly employed method of doing this uses an overhead mounted door control device that includes a pivoting arm attached between an upper portion of a door jamb and an upper part of a door. When the door is to be held open at an angle not exceeding about 110 degrees, an overhead mounted door control device is efficient, effective, convenient to install and maintain, is less subject to damage by vandalism or accidents, and does not present a stumbling hazard.

However, many conventional overhead door control devices are difficult to properly mount in an inset door top because of their sizes. Since time consuming or expensive modifications to the door may be required to properly fit the door holder, installation of door holders necessary for convenience or safety may be omitted or postponed. Alternatively, marginal performing conventional low profile door holders may be attached, leading to dissatisfaction and high maintenance and replacement costs.

It would be very desirable to have an overhead door holder assembly that is durable, easy to install as an inset into the top of a door, and replaceable with minimal effort and expertise. The door holder must be set to permit easy engagement, to hold the door against minor amounts of jostling contact without release, and yet to still permit closing the door without undue effort.

Such a door holder should not require special tools for installation or maintenance, but it should have features that prevent its damage from violent or forceful door opening. The door should automatically be held in an open position after it is swung open a predetermined angle, and should be easily released from its held open position when desired.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an overhead mounted door holder assembly, for attachment between a door jamb and a door, for selectively holding the door in an open position including a jamb bracket attached to the door jamb and a jamb arm pivotally attached to the jamb bracket; a channel assembly having a channel defined therein; a slide assembly positioned for movement in the channel and pivotally attached to the jamb arm; first and second springs attached to the channel assembly and positioned within the channel, with a spring mounted catch attached to these first and second springs, the spring mounted catch being positioned in the channel to engage a slide catch and hold the door in an open position.

The foregoing and other aspects will become apparent from the following detailed description of the invention when considered in conjunction with the accompanying drawing figures.

DETAILED DESCRIPTION OF THE INVENTION

Figure 1:
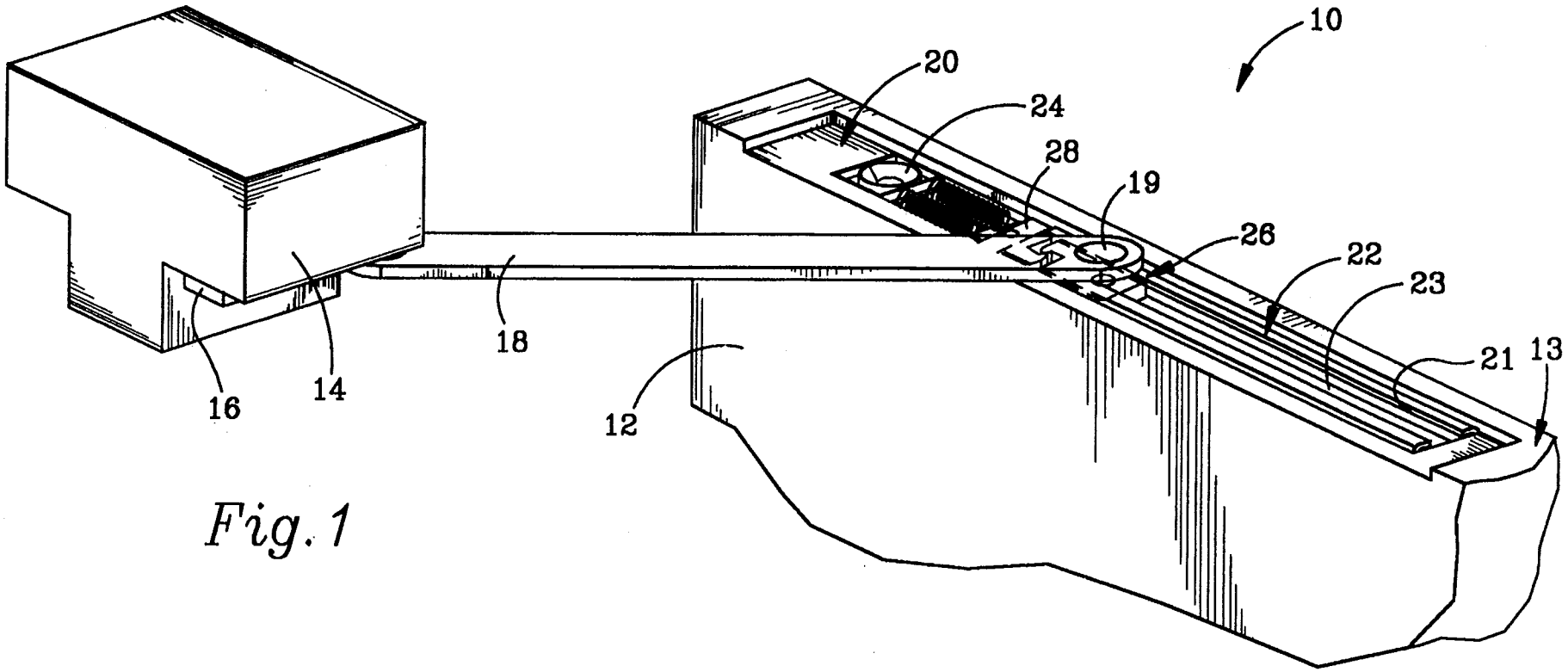
FIG. 1 is a perspective view of a low profile overhead mounted door holder assembly that includes a channel assembly inset into a top of a door.

FIG. 1 shows a door holder assembly 10 having a channel assembly 22 positioned in a door inset 20 at an upper edge 13 of a door 12. The channel assembly 22 is attached to the door 12 so that its generally U-shaped channel 23 is upwardly open. Positioned for movement within the channel 23 is a slide assembly 26. The door holder assembly 10 also includes a jamb bracket 16 fixed to a door jamb 14. A jamb arm 18 is pivotally connected at one end to the jamb bracket 16 and at its opposite end to the slide assembly 26. In preferred embodiments, the jamb bracket 16, jamb arm 18 and channel assembly 22 are formed from brass or other durable, wear resistant material such as steel.

When the door 12 is closed, the slide assembly 26 is positioned at the opposite end of the channel 23 from the spring support 24. As the door 12 is opened, the pivoting connection of the jamb arm 18 between the jamb bracket 16 and the slide assembly 26 causes the slide assembly 26 to move along the channel 23 toward a spring support 24 until it engages a spring mounted catch 28 that temporarily and reversibly holds the door in an open position. This held open position is illustrated in FIG. 1, which shows the door 12 in almost wide open state rotated about 100 degrees relative to the door jamb 14.

Figure 2:
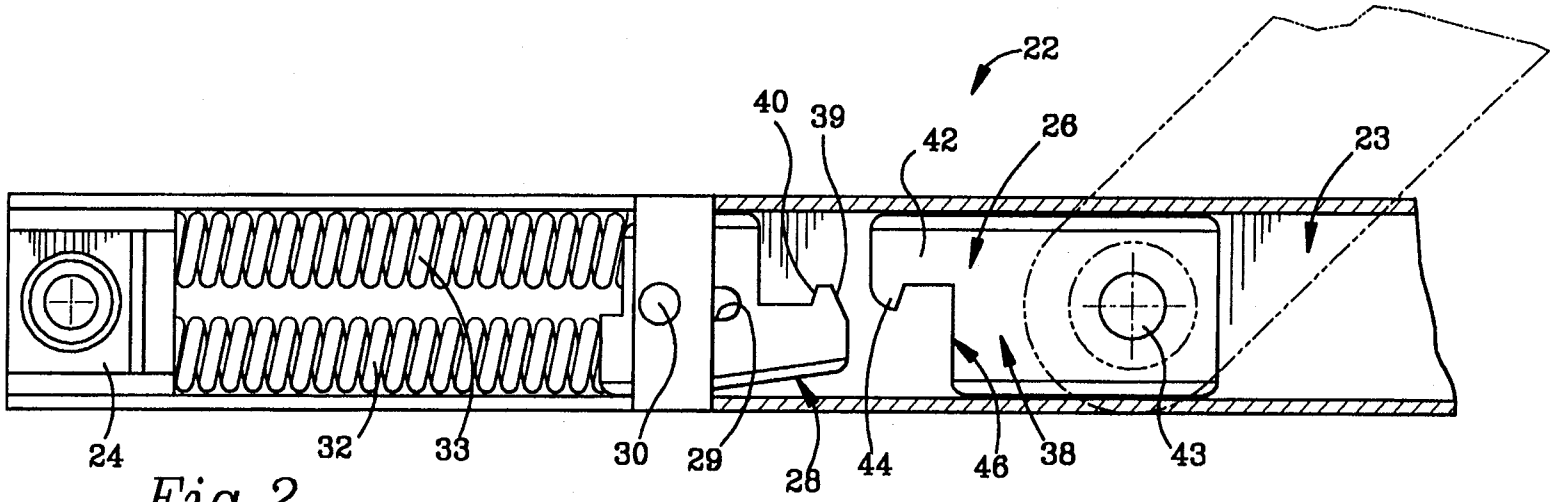
FIG. 2 is a side view illustrating a spring support for first and second springs, a spring mounted catch retained to pivot about a pin, and a slide assembly.

The spring mounted catch 28 and the slide assembly 26 are illustrated in a non-engaged position in FIG. 2. At an end closest to the slide catch 38, the spring mounted catch 28 has a projection consisting of opposing first and second ramps 39 and 40. Near or about its center, the spring mounted catch 28 is formed to define a longitudinally extending channel 29 therethrough, to allow retention of the spring mounted catch 28 by a pin 30 attached to the channel assembly 22 and passing through the slot 29. At the end opposite the ramps 39 and 40, the spring mounted catch 28 is connected to first and second springs 32 and 33. The first spring 32 is connected to the spring mounted catch 28 on one side of the slot 29, while the second spring 33 is connected to the spring mounted catch 28 on the other side of the slot 29. The pin 30 defines a pivot point which permits a pivoted, rocking movement of the spring mounted catch 28, which can both rotate and longitudinally move a limited distance by compression of one or both of the springs 32 and 33. The springs 32 and 33 preferably have substantially equal spring constants and resistance to compressive force.

The slide assembly 26 includes a slide piece 42 having a hook 44 for engagement with the spring mounted catch. In addition, the slide piece 42 has a substantially flat wall 46 for engagement with the spring mounted catch 28 as the slide assembly advances to contact the catch 28 during a forceful door opening. The slide piece 42 is connected to end 19 of jamb arm 18 through an aperture 48 by a connecting pivot 43 to allow sliding movement of the slide assembly 26 along the channel 23 as the jamb arm 18 moves in response to opening or closing of the door 12.

Figure 3:
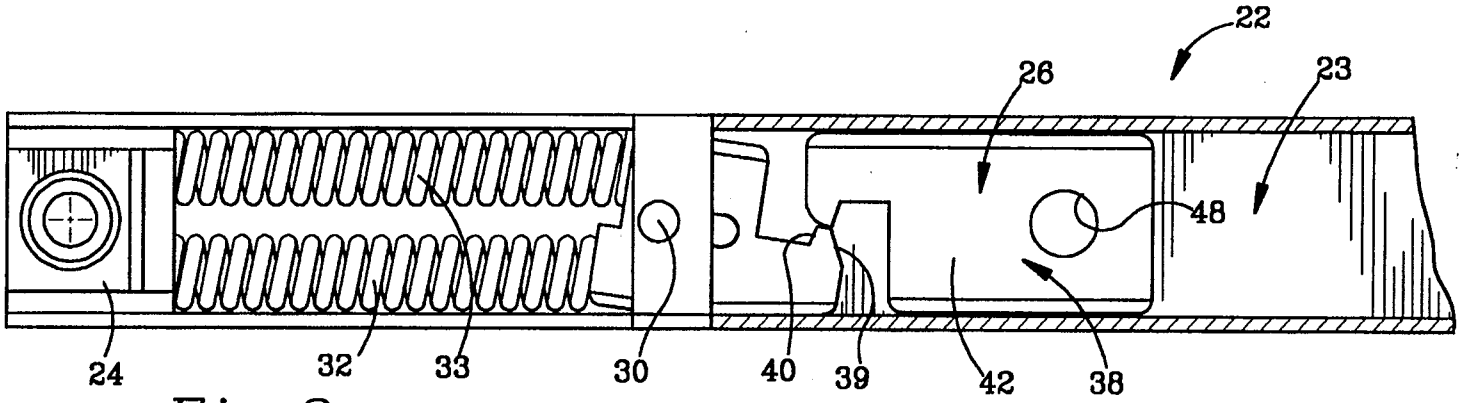
FIG. 3 is a side view similar to that illustrated in FIG. 2, showing a hook of the slide assembly in engagement with the spring mounted catch.
Figure 4:
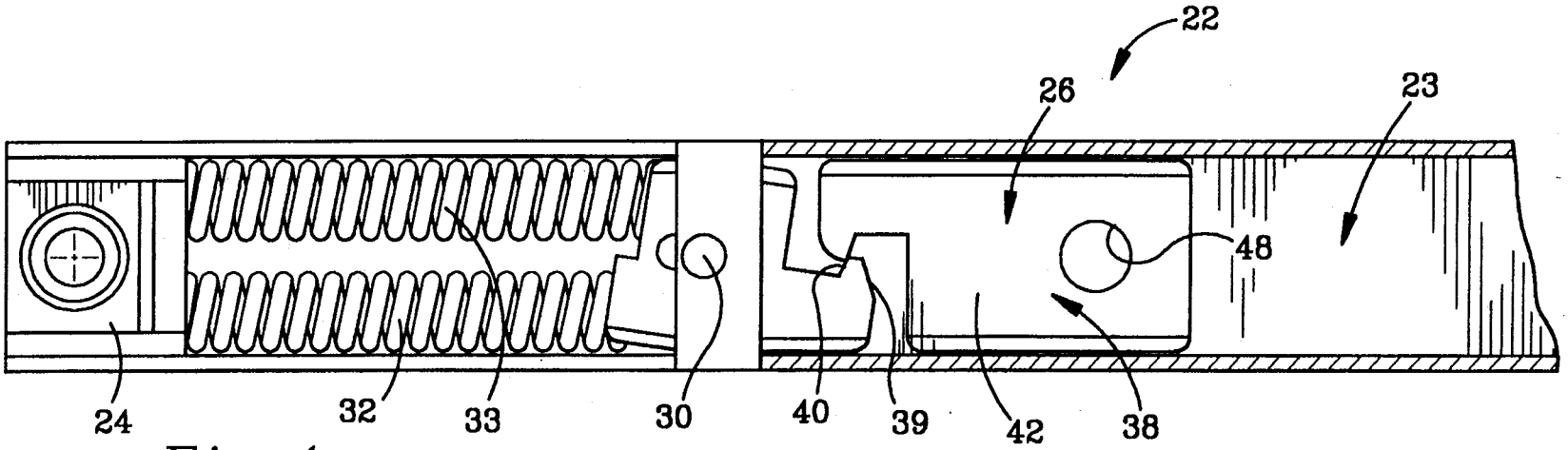
FIG. 4 is a side view similar to FIGS. 2 and 3, showing the hook of the slide assembly engaging the second ramp of the spring mounted catch in a door hold open position.
Figure 5:
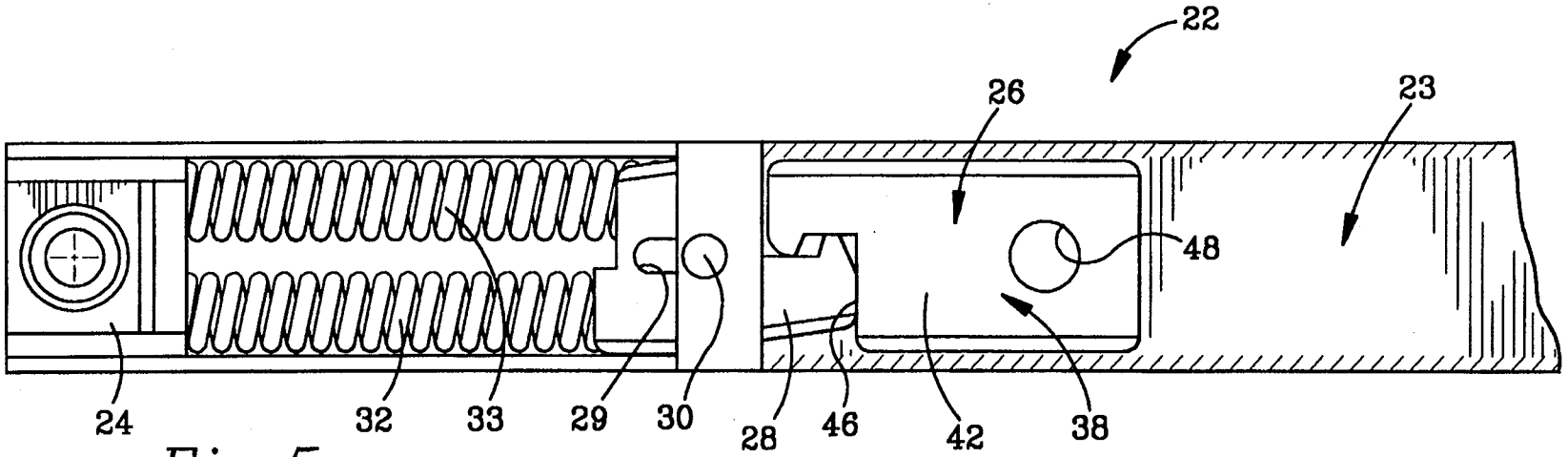
FIG. 5 is a side view similar to FIGS. 2, 3 and 4, with the slide assembly sufficiently advanced toward the first and second springs to engage a wall of the slide assembly with the spring mounted catch, forcing simultaneous compression of the first and second springs to absorb the shock of violent door opening.

Operation of the assembly 10 in its capacity as a door holder and forceful door opening impact absorber is best illustrated by sequential consideration of FIGS. 2, 3, 4, and 5, which illustrate positions of the slide assembly 26 relative to the spring mounted catch 28 as the door 12 is opened. More particularly, FIG. 2 shows the hook 44 of the slide piece 42 immediately before contact with the first ramp 39 of the spring mounted catch 28. FIG. 3 (with jamb arm 18 and connecting pivot 43 omitted for clarity) shows the position of the hook 44 on the first ramp 39 as continued motion of the slide assembly 26 toward the spring support 24 causes pivoted movement of the spring mounted catch 28, with the first spring 32 being compressed a greater amount than the second spring 33. FIG. 4 shows the position of the hook 44 against the second ramp 40 to hold the door in an open position. FIG. 5 shows the position of the wall 46 as it impacts spring mounted catch 28 to transfer force of violent door opening to the springs 32 and 33 and absorb shock impact that could damage assembly 10. Reversal of this sequence simply and efficiently disengages the door 12 from the hold open position.

What is claimed is:

1. A door holder assembly for attachment between a door jamb and a door, the assembly comprising a jamb arm and means for pivotally attaching the jamb arm to a door jam, a channel assembly attachable to a door and having an upwardly opening channel defined therein, door holding means for holding a door positioned within the channel assembly, the door holding means comprising a catch, a pivot pin connecting the catch to the channel assembly, and first and second springs connected to the catch to bias the catch to a first position, the first and second springs being positioned side-by-side aligned in balanced opposition to each other on opposite sides of the pivot pin, sliding means pivotally attached to the jamb arm and positioned for longitudinal movement within the channel, the sliding means having a slide piece including a hook for engaging the holding means by pivotally displacing the catch from the first position and a wall for contacting the holding means to distribute the force of door opening.

2. The door holder assembly of claim 1, wherein the door holding means further comprises a spring support attached to the channel assembly at a fixed position within the channel.

3. The door holder assembly of claim 2, wherein the first and second springs are positioned between the spring support and the catch to resist compression and absorb door opening force as the sliding means impacts the catch.

4. The door holder assembly of claim 3, wherein the first and second springs are longitudinally positioned in the channel in parallel, spaced apart relationship to each other, with both springs having substantially equal spring constants and resistance to compressive force.

5. The door holder assembly of claim 1, wherein the catch has a slot defined therethrough, and the pivot pin is attached to the channel assembly to extend through the slot defined in the catch to permit limited longitudinal movement of the catch in the channel.

6. The door holder assembly of claim 5, wherein the first spring is connected to the catch on one side of the slot defined through the catch and the second spring is connected to the catch on the opposite side of the slot for pivoting movement of the catch about the pivot pin.

7. The door holder assembly of claim 1, wherein the catch further comprises a first ramp to slidingly engage the hook of the slide piece as it advances toward the first and second springs and a second ramp to hinder release of the hook from the catch as the slide assembly is forced away from the first and second springs.

8. An overhead door holder assembly for attachment between a door jamb and a door for selectively holding the door in an open position, the assembly comprising a jamb bracket attached to the door jamb, a jamb arm pivotally attached to the jamb bracket, a channel assembly having a channel therein, a slide assembly positioned for sliding movement in the channel, the slide assembly being pivotally attached to the jamb arm, and including a slide piece having a hook, a catch positioned in the channel to engage the slide piece for holding the door in an open position, a pivot pin attached to the channel assembly and extending through a central portion of the catch permitting pivotal movement of the catch about the pin, and first and second compression springs positioned side-by-side within the channel, a spring support coupling a first end of each spring to the channel, the first and second compression springs having second ends abutting the catch on opposite sides of the pivot pin, the catch being biased toward a slide engaging position by the first and second compression springs.

9. The door holder assembly of claim 8, wherein the first and second springs are longitudinally positioned in the channel in parallel, spaced apart relationship to each other, with both springs having substantially equal spring constants and resistance to compressive force.

10. The overhead door holder assembly of claim 8, wherein the spring mounted catch has a slot defined therethrough, and said pivot pin is attached to the channel assembly to extend through the slot defined in the spring mounted catch.

11. The overhead door assembly of claim 10 wherein the first spring is connected to the spring mounted catch on one side of the slot defined through the spring mounted catch and the second spring is connected to the spring mounted catch on the opposite side of the slot, permitting limited pivoting movement of the spring mounted catch about the pin, and the catch further comprising a first ramp to slidingly engage the hook of the slide assembly as the slide assembly advances toward the first and second springs and a second ramp to hinder release of the hook from the spring mounted catch as the slide assembly is forced away from the first and second springs.

12. The overhead door holder assembly of claim 8, wherein the catch further comprises a first ramp to slidingly engage the hook of the slide piece as it advances toward the first and second springs and a second ramp to hinder release of the hook from the spring mounted catch as the slide assembly is forced away from the first and second springs.

13. The overhead door holder assembly of claim 8, wherein the slide assembly further comprises a wall for engagement with the slide catch to transmit any excess force of door opening to the first and second springs.

14. The overhead door holder assembly of claim 8, wherein the first and second springs are positioned to resist compression and absorb door opening force as the slide assembly impacts the catch.

15. An overhead mounted door holder assembly, for attachment between a door jamb and a door, to selectively hold the door in an open position, comprising a channel assembly having a channel therein, a slide assembly positioned for movement in the channel and having a slide piece including a hook, said slide piece being pivotally attached to a jamb arm extending between the door jamb and the door, a catch including a slot, a pivot pin fixed to the channel and passing through the slot, the catch being positioned in the channel to engage the slide hook and hold the door in an open position, and first and second compression springs positioned side-by-side parallel to each other within the channel, the springs having first ends attached to the channel assembly and second ends attached to the catch on opposite sides of the slot permitting limited pivoting movement of the catch about the pivot pin inhibiting engagement and disengagement of the catch and slide hook.

* * * * *